US010709305B2

(12) United States Patent
Fogarty, Jr. et al.

(10) Patent No.: US 10,709,305 B2
(45) Date of Patent: Jul. 14, 2020

(54) VACUUM CLEANING SYSTEM INCLUDING AN ELECTRICAL CONNECTION INTERFACE

(71) Applicant: Emerson Electric Co., St. Louis, MO (US)

(72) Inventors: Thomas E. Fogarty, Jr., Alton, IL (US); Alex J. Wall, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 300 days.

(21) Appl. No.: 15/619,852

(22) Filed: Jun. 12, 2017

(65) Prior Publication Data

US 2018/0353033 A1 Dec. 13, 2018

(51) Int. Cl.

| | |
|---|---|
| ***A47L 9/26*** | (2006.01) |
| ***A47L 7/00*** | (2006.01) |
| ***B65H 75/42*** | (2006.01) |
| ***A47L 5/30*** | (2006.01) |
| ***A47L 9/28*** | (2006.01) |
| ***A47L 5/22*** | (2006.01) |
| ***A47L 9/32*** | (2006.01) |
| ***A47L 5/00*** | (2006.01) |

(52) U.S. Cl.

CPC ..... *A47L 9/26* (2013.01); *A47L 5/225* (2013.01); *A47L 5/30* (2013.01); *A47L 7/0085* (2013.01); *A47L 9/28* (2013.01); *A47L 9/2878* (2013.01); *A47L 9/2884* (2013.01); *A47L 9/325* (2013.01); *B65H 75/42* (2013.01); *A47L 5/00* (2013.01); *B65H 2601/324* (2013.01); *B65H 2701/34* (2013.01)

(58) Field of Classification Search

CPC . A47L 9/26; A47L 9/28; A47L 9/2878; A47L 9/2884

See application file for complete search history.

(56) References Cited

U.S. PATENT DOCUMENTS

| | | | |
|---|---|---|---|
| 3,251,107 | A | 5/1966 | Scott |
| 4,106,165 | A | 8/1978 | Clowers et al. |
| 4,858,271 | A | 8/1989 | Berfield et al. |

(Continued)

FOREIGN PATENT DOCUMENTS

| | | | |
|---|---|---|---|
| CN | 2167472 | Y | 6/1994 |
| EP | 2941993 | A1 | 11/2015 |

OTHER PUBLICATIONS

Proteam Cord Holder, Mfr #: 102604, accessed Jan. 13, 2017 at Zoro.com, Zoro #:G3378125, 3pp.

*Primary Examiner* — Andrew A Horton

(74) *Attorney, Agent, or Firm* — Armstrong Teasdale LLP

(57) ABSTRACT

A vacuum cleaning system includes an upright vacuum cleaner operable in a cordless mode and a corded mode. The upright vacuum cleaner includes a cleaning head for removing debris from a floor, a debris tube connected to the cleaning head for receiving the debris, and an electrical connection interface. The vacuum cleaning system also includes a battery and a power cord adapted for connection to the electrical connection interface. The upright vacuum cleaner operates in the cordless mode when the battery is connected to the electrical connection interface. The vacuum cleaner operates in the corded mode when the power cord is connected to the electrical connection interface.

18 Claims, 14 Drawing Sheets

(56) References Cited

U.S. PATENT DOCUMENTS

| | | | | |
|---|---|---|---|---|
| 4,875,879 | A | 10/1989 | Bunyea et al. | |
| 5,318,158 | A | 6/1994 | Seasholtz | |
| 6,351,872 | B1 * | 3/2002 | McCormick | A47L 5/30 15/334 |
| 7,004,785 | B2 | 2/2006 | Melton et al. | |
| 7,411,133 | B2 | 8/2008 | Morgan et al. | |
| 7,765,640 | B2 | 8/2010 | Morgan et al. | |
| 2006/0057882 | A1 | 3/2006 | Wascow et al. | |
| 2006/0218746 | A1 | 10/2006 | Morgan et al. | |
| 2012/0137466 | A1 | 6/2012 | Duncan | |
| 2014/0245564 | A1 * | 9/2014 | Conrad | A47L 9/1683 15/353 |
| 2015/0104967 | A1 * | 4/2015 | Jaan | H01R 13/6275 439/352 |
| 2016/0022102 | A1 | 1/2016 | Theising | |
| 2016/0233810 | A1 | 8/2016 | Williams et al. | |
| 2017/0042400 | A1 * | 2/2017 | Lee | A47L 9/26 |

* cited by examiner

VACUUM CLEANING SYSTEM INCLUDING AN ELECTRICAL CONNECTION INTERFACE

FIELD

The field relates to vacuum cleaning systems and, in particular, upright vacuum cleaners that include an electrical connection interface to connect to a detachable power cord and a battery.

BACKGROUND

Vacuum cleaners typically include a power cord that extends from the vacuum cleaner and connects to a power source. During operation, the maneuverability and range of the vacuum cleaner may be limited by the power cord. In addition, the vacuum cleaner may not be able to reach some areas while the power cord is connected to the power source. Moreover, the power cord may experience stress and may be disconnected from the vacuum or the power source as a user attempts to maneuver the vacuum cleaner.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaning system includes an upright vacuum cleaner operable in a cordless mode and a corded mode. The upright vacuum cleaner includes a cleaning head for removing debris from a floor, a debris tube connected to the cleaning head for receiving the debris, and an electrical connection interface. The vacuum cleaning system also includes a battery and a power cord adapted for connection to the electrical connection interface. The upright vacuum cleaner operates in the cordless mode when the battery is connected to the electrical connection interface. The vacuum cleaner operates in the corded mode when the power cord is connected to the electrical connection interface.

In another aspect, an upright vacuum cleaner is operable in a cordless mode and a corded mode. The vacuum cleaner includes a cleaning head for removing debris from a floor, a debris tube connected to the cleaning head for receiving the debris, and a handle assembly attached to the debris tube. The upright vacuum cleaner also includes a support plate extending from the debris tube to support a battery. The upright vacuum cleaner further includes an electrical connection interface attached to one of the handle assembly, the debris tube, and the support plate. The electrical connection interface is adapted for connection to the battery and a power cord. The upright vacuum cleaner operates in the cordless mode when the battery is connected to the electrical connection interface and operates in the corded mode when the power cord is connected to the electrical connection interface.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
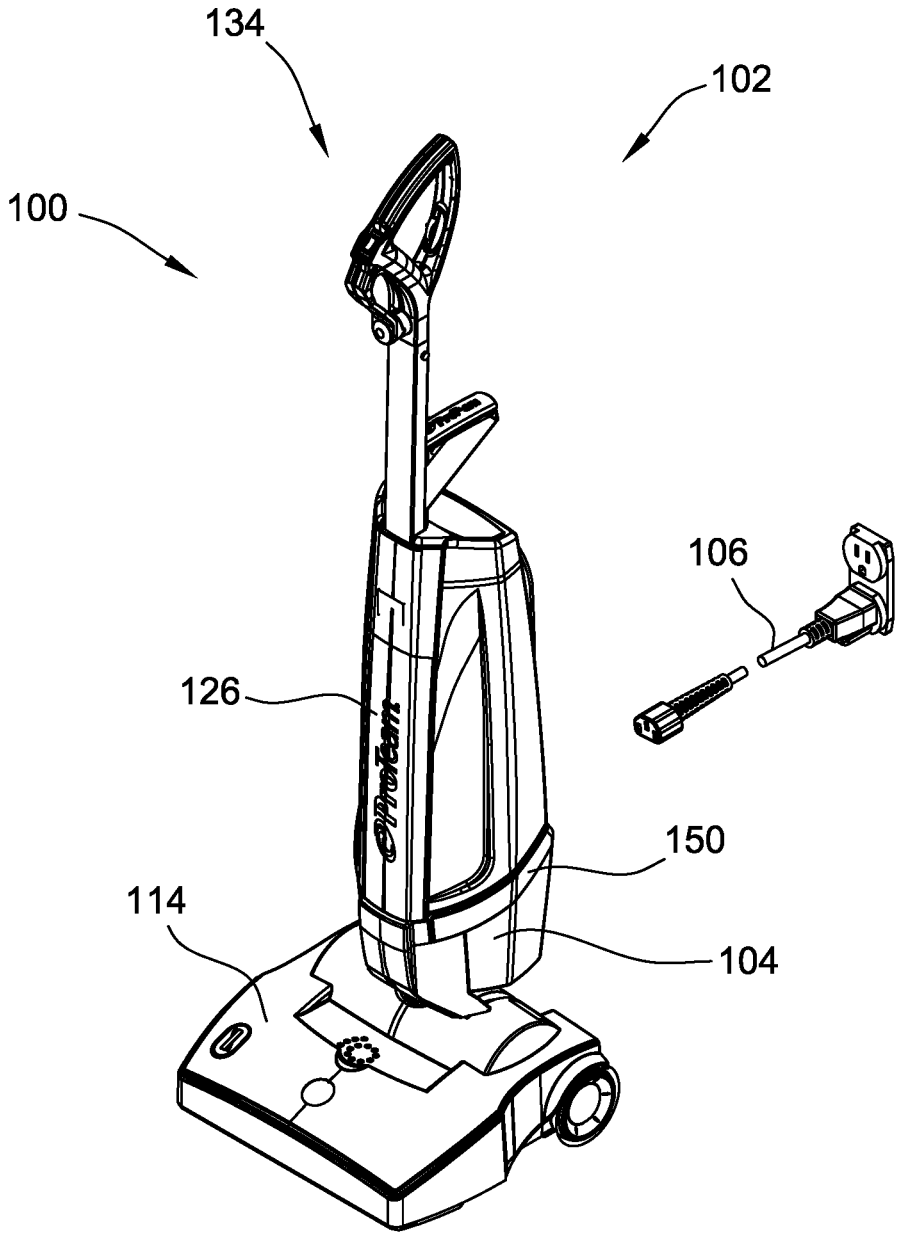
FIG. 1 is a perspective view of a vacuum cleaning system including a vacuum cleaner.
Figure 2:
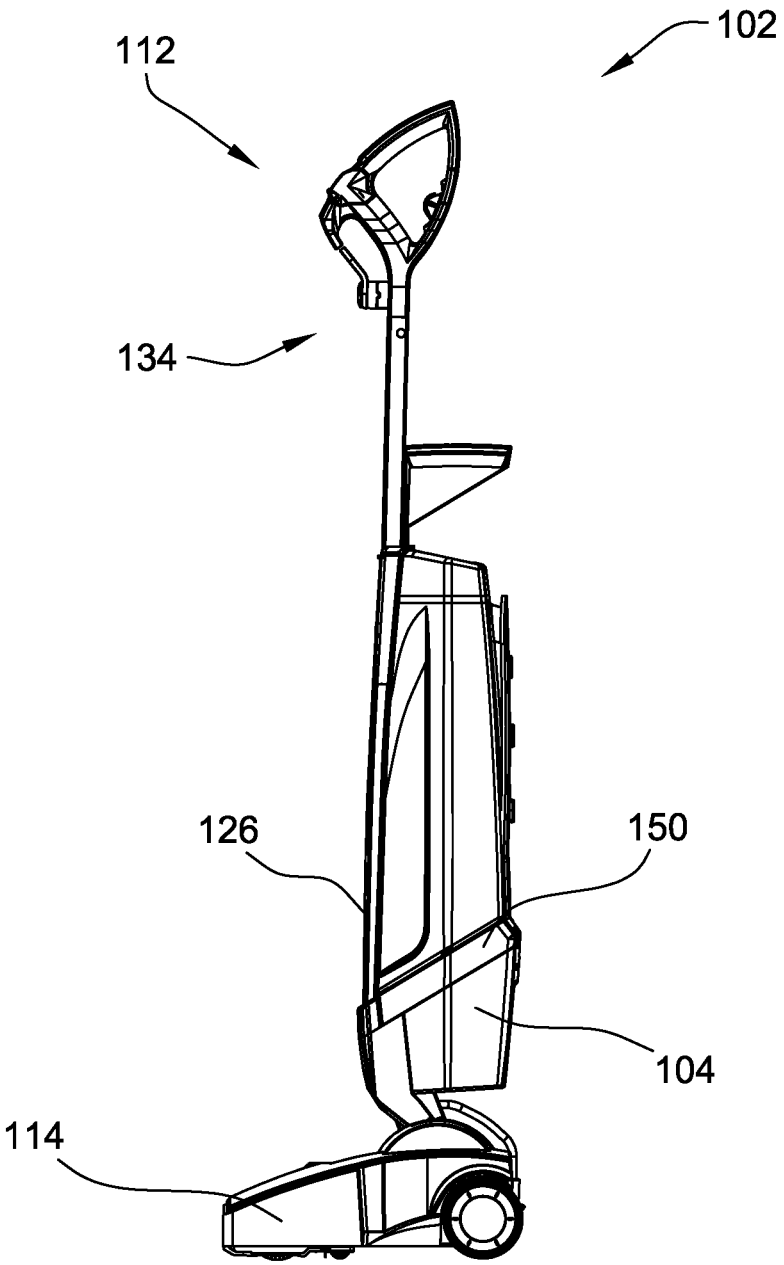
FIG. 2 is a side view of the vacuum cleaner in a cordless mode.
Figure 3:
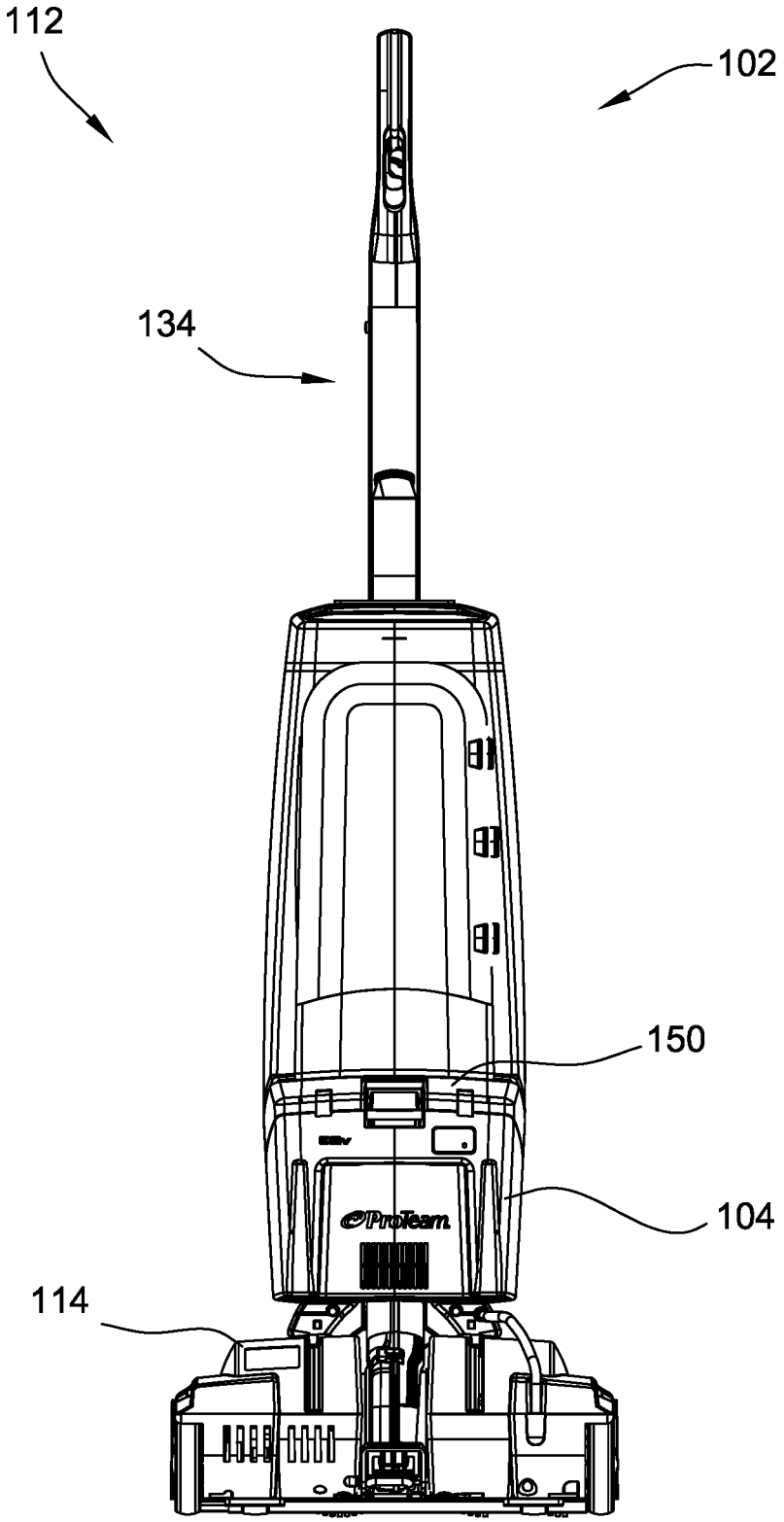
FIG. 3 is a rear view of the vacuum cleaner in the cordless mode.
Figure 4:
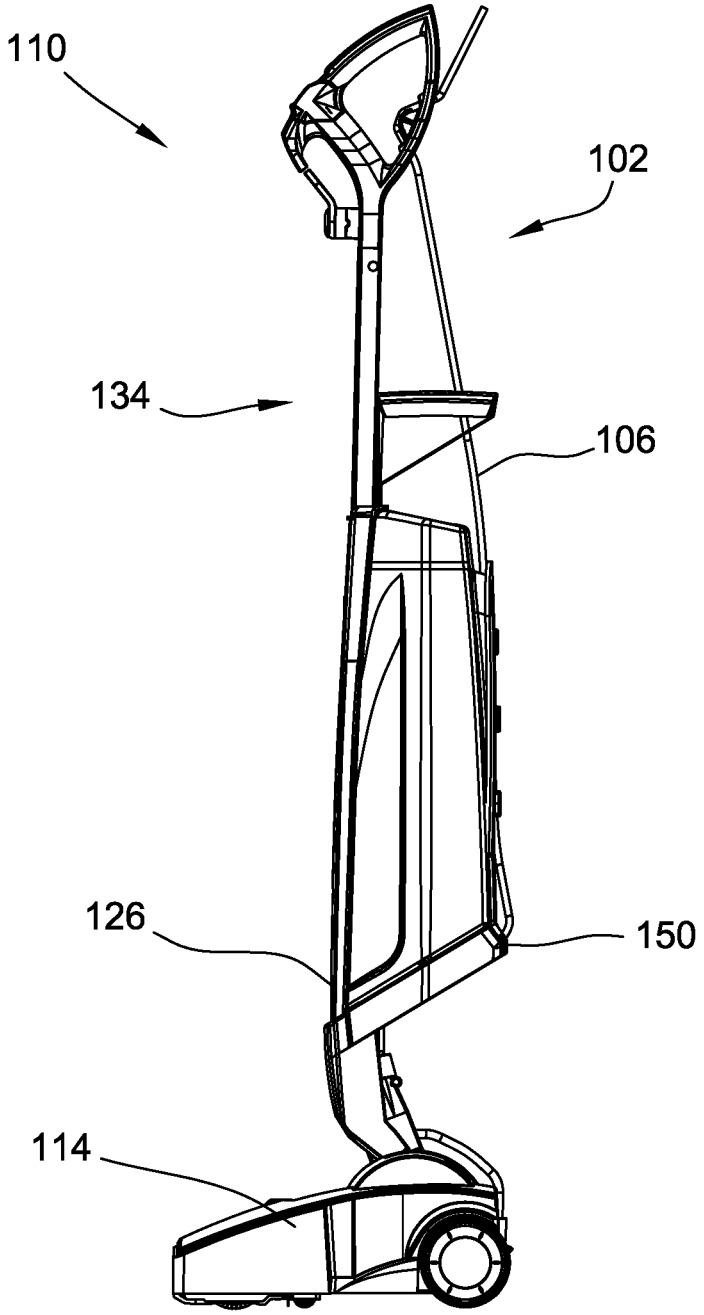
FIG. 4 is a side view of the vacuum cleaner in a corded mode.
Figure 5:
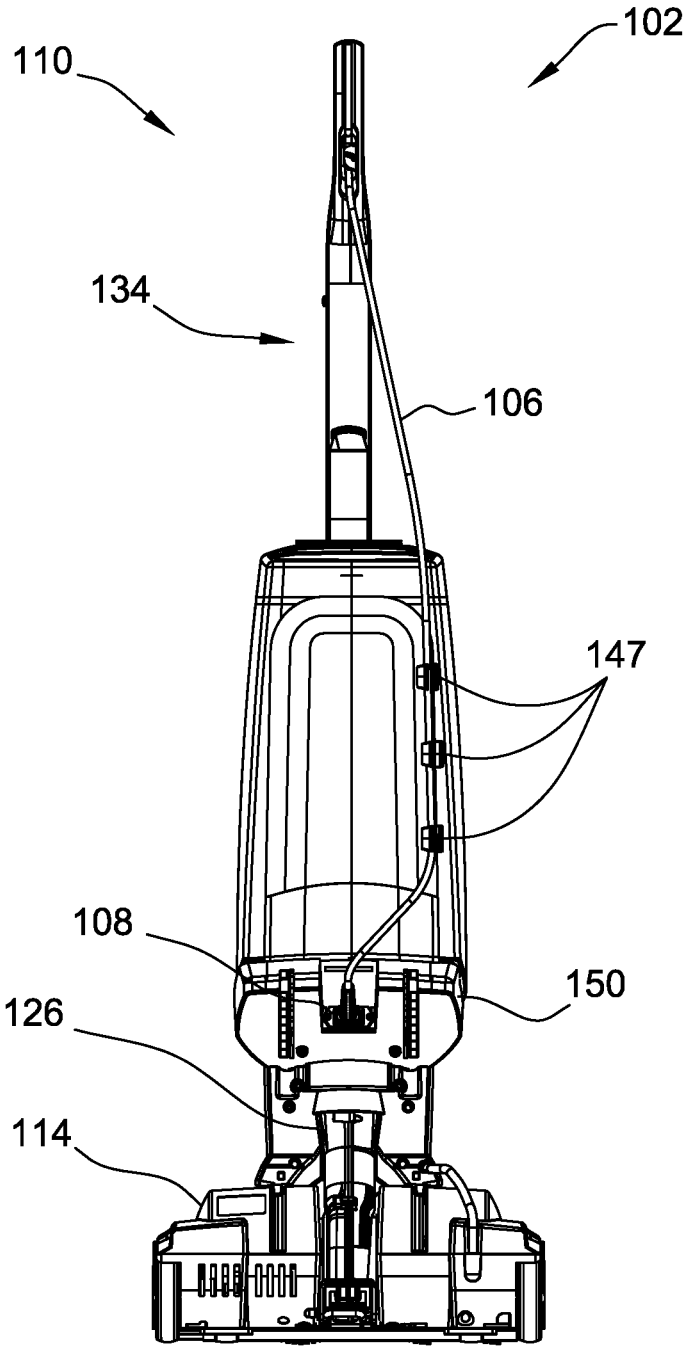
FIG. 5 is a rear view of the vacuum cleaner in the corded mode.

FIG. 1 is a perspective view of an example vacuum cleaning system 100. Vacuum cleaning system 100 includes a vacuum cleaner 102, a battery 104, and a power cord 106. Vacuum cleaner 102 may be connected to and receive power from battery 104 or power cord 106. In particular, vacuum cleaner 102 includes an electrical connection interface 108 (shown in FIG. 6) for connecting vacuum cleaner 102 to battery 104 and power cord 106. Accordingly, vacuum cleaner 102 may be operated in a cordless mode 110 (shown in FIGS. 2 and 3) and a corded mode 112 (shown in FIGS. 4 and 5). Electrical connection interface 108 is a common connection point for battery 104 and power cord 106. Accordingly, electrical connection interface 108 simplifies assembly and operation of vacuum cleaning system 100. In addition, electrical connection interface 108 ensures that only one of battery 104 and power cord 106 may be connected to and provide power to vacuum cleaner 102 at a time.

In this embodiment, electrical connection interface 108 conforms to standards set by industry authorities. In particular, in this embodiment, electrical connection interface 108 conforms to standards set by the International Electrotechnical Commission (IEC). Examples of suitable IEC electrical connection interfaces include, without limitation, IEC types A-N sockets and IEC types A-N plugs. In this embodiment, electrical connection interface 108 includes an IEC Appliance type C18 Inlet. As a result, electrical connection interface 108 is compatible with batteries and power cords that include IEC Appliance and Interconnection Couplers. For example, in this embodiment, battery 104 and power cord 106 include IEC type C13 and C17 connectors, respectively. In other embodiments, vacuum cleaner 102 may include any electrical connection interface 108 that enables vacuum cleaner 102 to operate as described.

Figure 6:
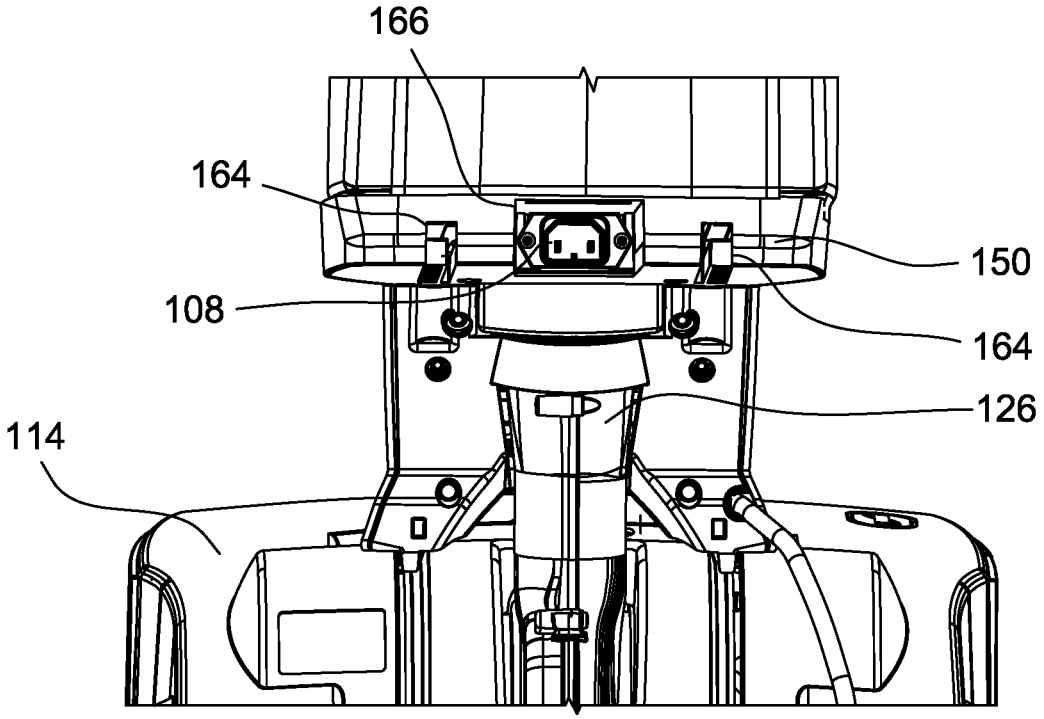
FIG. 6 is a rear view of a portion of the vacuum cleaner showing an electrical connection interface of the vacuum cleaner.

In reference to FIG. 6, electrical connection interface 108 is on an exterior of vacuum cleaner 102 and is uncovered. In particular, electrical connection interface 108 is attached to a battery support plate 150, which extends from a debris tube 126. Accordingly, electrical connection interface 108 is accessible and connects to battery 104 and power cord 106 without disassembling vacuum cleaner 102. As a result, it is easier for a user to switch vacuum cleaner 102 between corded mode 112 and cordless mode 110. For example, vacuum cleaner 102 may be switched between corded mode 112 and cordless mode 110 without the use of tools and without moving an access panel. In other embodiments, electrical connection interface 108 may be located anywhere on vacuum cleaner 102 that enables vacuum cleaner 102 to operate as described. For example, in some embodiments, electrical connection interface 108 is attached to handle assembly 134.

Figure 7:
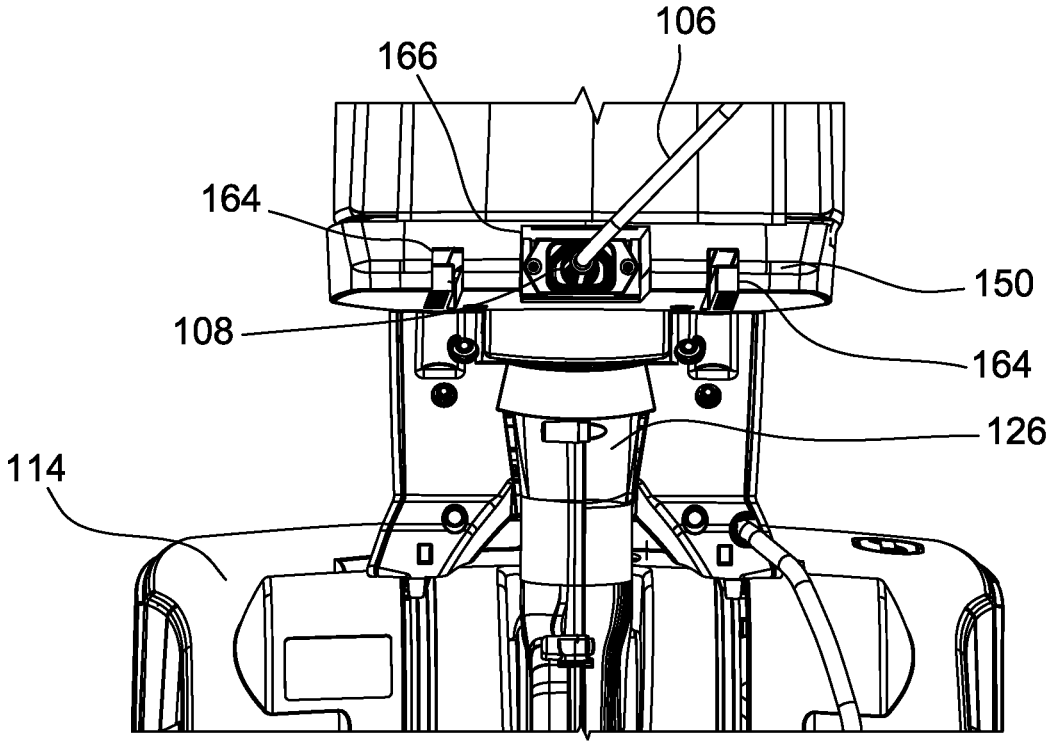
FIG. 7 is a rear view of a portion of the vacuum cleaner showing a power cord connected to the electrical connection interface.
Figure 8:
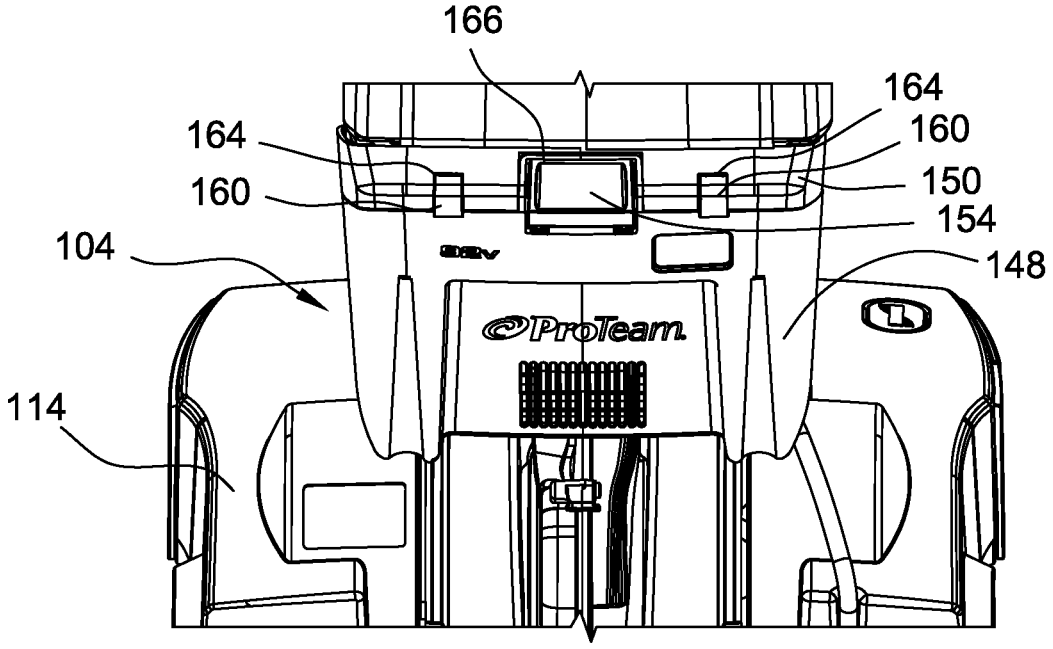
FIG. 8 is a rear view of a portion of the vacuum cleaner showing a battery connected to the electrical connection interface.

In reference to FIGS. 6-8, a user may connect power cord 106 to electrical connection interface 108 to operate vacuum cleaner 102 in corded mode 112. Corded mode 112 may provide additional power to vacuum cleaner 102 and prevent loss of power to vacuum cleaning system 100 during operation. To switch to cordless mode 110, the user disconnects power cord 106 from electrical connection interface 108 and connects battery 104 to electrical connection interface 108. Cordless mode 110 may allow vacuum cleaning system 100 to reach areas that would be outside the range of vacuum cleaner 102 in corded mode 112. In addition, cordless mode 110 may provide vacuum cleaning system 100 with increased maneuverability. In other embodiments, vacuum cleaning system 100 may operate in any suitable mode.

Figure 13:
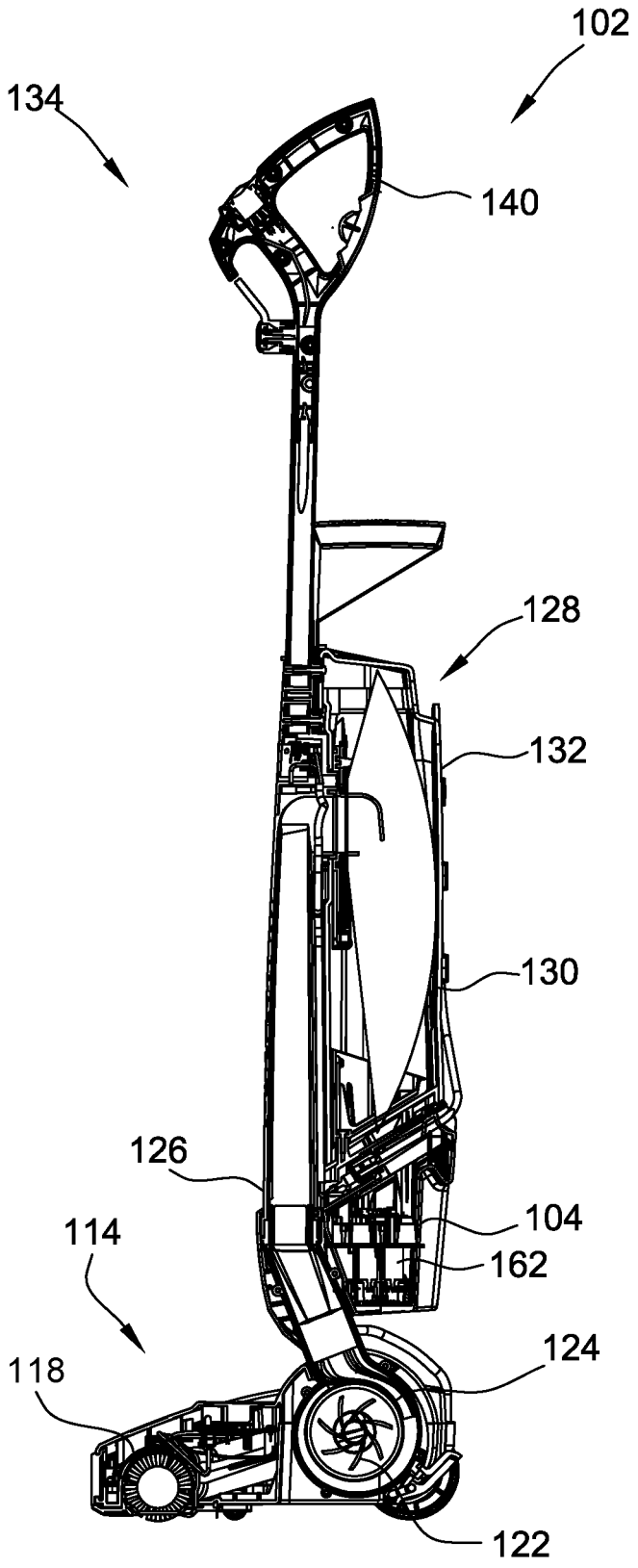
FIG. 13 is a sectional view of the vacuum cleaner in a cordless mode.
Figure 14:
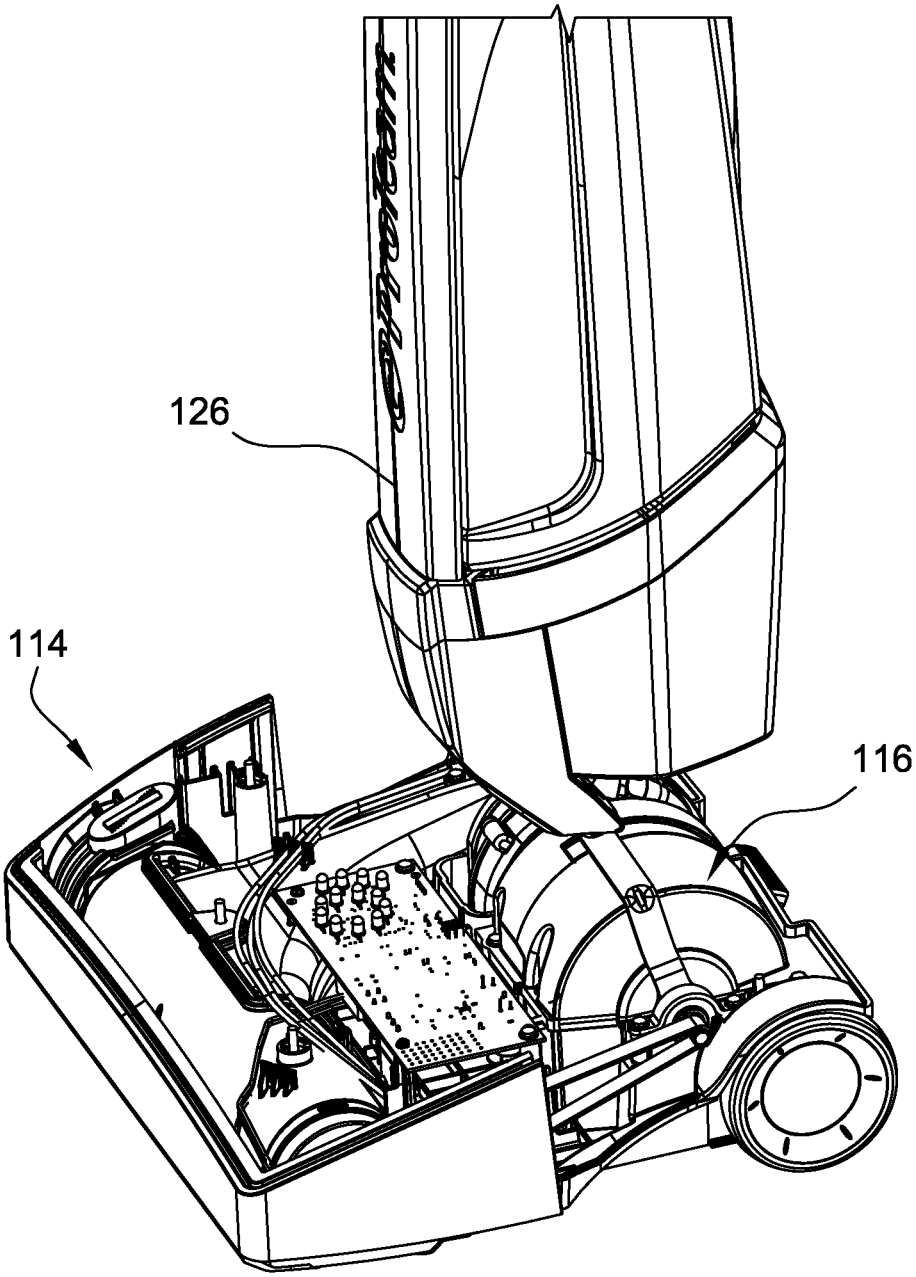
FIG. 14 is a perspective view of a cleaning head of the vacuum cleaner with a cover removed.

In reference to FIGS. 13 and 14, vacuum cleaner 102 includes a cleaning head 114 for removing debris from a floor and directing the debris into vacuum cleaner 102. Cleaning head 114 includes a motor assembly 116 that powers a rotary brush 118. Rotary brush 118 includes one or more brushes (not shown) that rotate and contact the floor to agitate debris and promote entrainment of the debris into airflow into vacuum cleaner 102. A blower or fan 122 pulls air and debris from rotary brush 118, through a blower housing 124 and into blower 122. Blower 122 pushes the air and debris into a debris tube 126 that extends upward from cleaning head 114. Debris tube 126 is pivotally attached to cleaning head 114.

Debris tube 126 is fluidly connected to blower 122 and a filter assembly 128. Air and debris travel up debris tube 126 and are discharged into filter assembly 128, where debris is filtered from the air and collected. Filter assembly 128 is disposed within a filter housing 130. Filter housing 130 may include rigid (e.g., plastic) and/or flexible (e.g., fabric) components.

In this embodiment, filter housing 130 includes an access door 132 to allow access to filter assembly 128 (e.g., to insert or remove a filter). Filter assembly 128 may include any filter that allows air to pass through and retains at least some debris within filter assembly 128. For example, in some embodiments, filter assembly 128 may include a flexible filter such as a bag filter. In other embodiments, filter assembly 128 may include a rigid filter.

Figure 9:
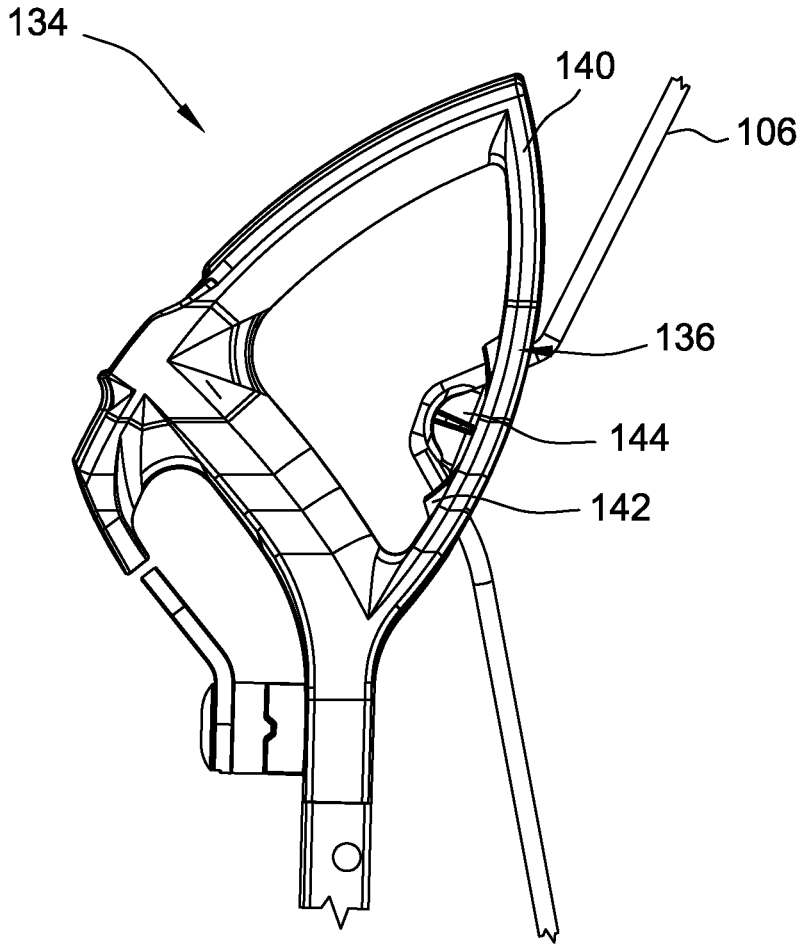
FIG. 9 is a perspective view of a handle of the vacuum cleaner.
Figure 10:
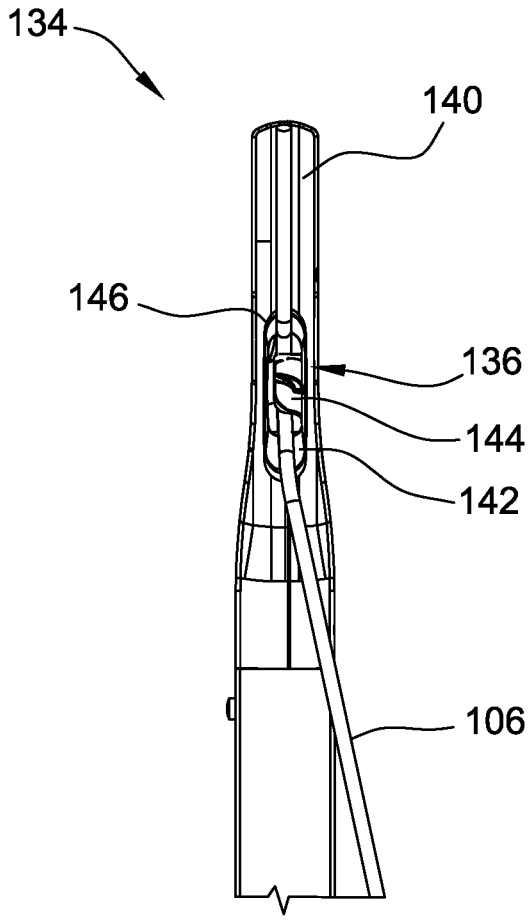
FIG. 10 is a side view of the handle.
Figure 11:
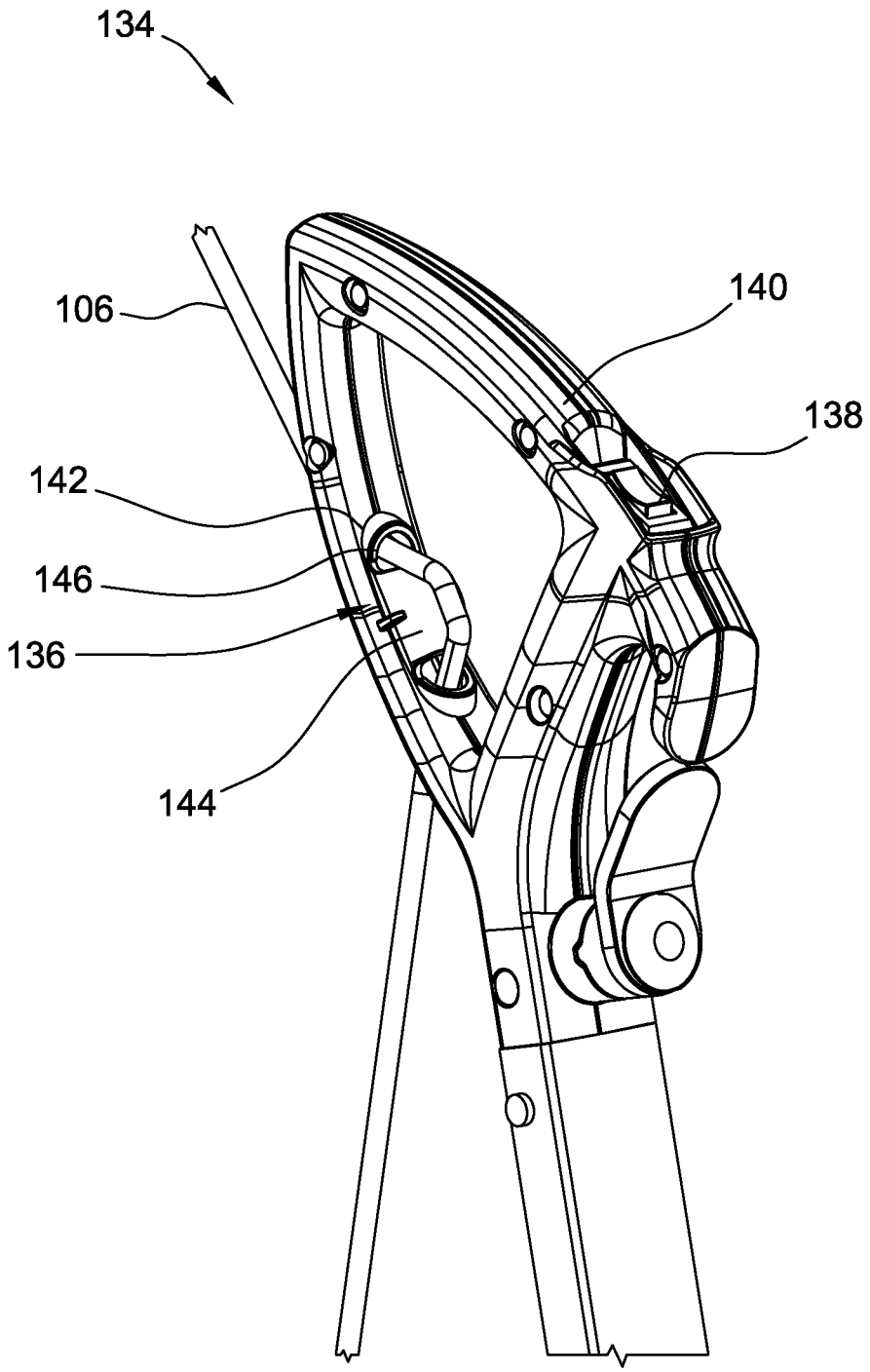
FIG. 11 is a rear view of the handle.

In reference to FIGS. 9-11, a handle assembly 134 is attached to debris tube 126 (shown in FIG. 13). Handle assembly 134 includes a cord holder 136, a power switch 138, and a handle 140. Power switch 138 is attached to handle 140 and is positionable between an ON position and an OFF position to control power to vacuum cleaner 102. When power switch 138 is in the ON position and vacuum cleaner 102 is in corded mode 112 (shown in FIGS. 4 and 5), power is supplied to vacuum cleaner 102 through power cord 106 from an AC power source. When power switch 138 is in the ON position and vacuum cleaner 102 is in cordless mode 110 (shown in FIGS. 2 and 3), DC power is supplied to vacuum cleaner 102 from battery 104. In addition, the ON position of power switch 138 may include a high-speed setting and a low-speed setting. In other embodiments, vacuum cleaner 102 may include any power switch 138 that enables vacuum cleaner 102 to operate as described. For example, in some embodiments, power switch 138 may be attached to cleaning head 114.

Cord holder 136 includes an annular body 142 and a hook 144. Annular body 142 defines an opening 146. Hook 144 extends from one side of annular body 142 towards an opposite side of annular body 142. Hook 144 extends partially across opening 146 such that a gap is formed between a distal end of hook 144 and annular body 142. In addition, hook 144 is curved and extends away from annular body 142. In this embodiment, cord holder 136 may be formed as a single piece. In other embodiments, vacuum cleaner 102 may include any cord holder 136 that enables vacuum cleaner 102 to operate as described.

In this embodiment, cord holder 136 secures power cord 106 to handle 140. For example, a user may position power cord 106 in opening 146 by sliding power cord 106 through the gap between hook 144 and annular body 142. Then, the user may extend power cord 106 across hook 144 and apply tension to one side of power cord 106 to trap power cord 106 against hook 144. In addition, clips 147 are positioned along debris tube 126 to secure power cord 106 to vacuum cleaner 102 and route power cord 106 towards cord holder 136. In some embodiments, vacuum cleaner 102 may include characters to indicate to a user how to route power cord 106. When power cord 106 is secured to vacuum cleaner 102, cord holder 136 and clips 147 maintain an amount of slack in power cord 106 between handle assembly 134 and electrical connection interface 108 to relieve stress on power cord 106 during operation of vacuum cleaner 102. Accordingly, cord holder 136 and clips 147 may prevent power cord 106 being disconnected from electrical connection interface 108 due to tension in power cord 106 during operation.

Figure 12:
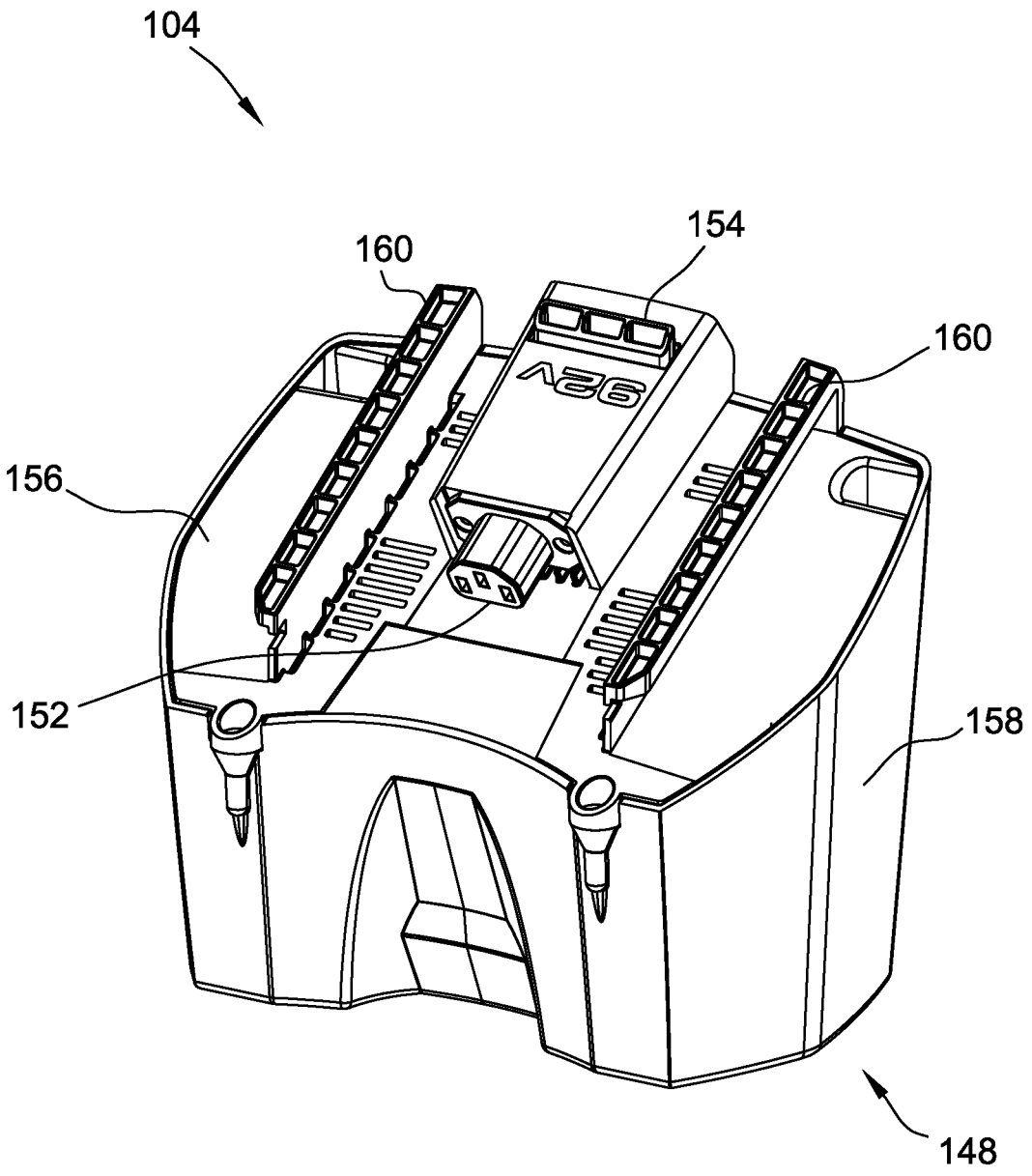
FIG. 12 is a perspective view of the battery shown in FIG. 8.

FIG. 12 is a perspective view of battery 104. Battery 104 includes a casing 148, an electrical connection interface 152, and a latch 154. Electrical connection interface 152 engages electrical connection interface 108 (shown in FIG. 6) of vacuum cleaner 102 (shown in FIG. 1) to electrically connect battery 104 and vacuum cleaner 102. Casing 148 includes a base plate 156, a sidewall 158, and rails 160. Sidewall 158 is connected to and extends about an outer edge of base plate 156. Rails 160 extend longitudinally along base plate 156 on either side of electrical connection interface 152. In other embodiments, battery 104 may include any casing 148 that enables battery 104 to operate as described.

In reference to FIG. 13, battery 104 includes a battery core 162. For example, battery core 162 may include any suitable power storage device such as a lithium ion core, a lead-acid core, a nickel-cadmium core, a nickel-zinc core, and a nickel metal hydride core. In other embodiments, battery 104 may include any battery core that enables battery 104 to function as described. For example, battery 104 may include, without limitation, any primary type and/or secondary type of battery cells and/or energy storage capacitor arrangements.

As shown in FIG. 8, battery 104 may be releasably attached to and supported by battery support plate 150. Battery support plate 150 is attached to and extends from debris tube 126. When battery 104 is connected to battery support plate 150, rails 160 are received in slots 164 in battery support plate 150. In this embodiment, battery support plate 150 includes two slots 164 and casing 148 includes two rails 160. A portion of latch 154 is received within an opening 166 in battery support plate 150. To connect battery 104 and vacuum cleaner 102, rails 160 are slid into slots 164 of battery support plate 150 and latch 154 engages opening 166 to secure battery 104 to battery support plate 150. Latch 154 may be depressed to release battery 104 from battery support plate 150. Electrical connection interface 108 (shown in FIG. 6) is positioned to connect to battery 104 when battery 104 is connected to battery support plate 150. In other embodiments, battery 104 may be connected to battery support plate 150 in any manner that enables vacuum cleaner 102 to operate as described.

Compared to conventional vacuum cleaning systems, the vacuum cleaning systems of embodiments of the present disclosure have several advantages. For example, embodiments of the upright vacuum cleaner include an electrical connection interface to connect to a battery and a power cord such that the upright vacuum cleaner may operate in a corded mode and a cordless mode. The electrical connection interface is configured to inhibit connecting to the battery and the power cord at the same time. In particular, the electrical connection interface is occupied by either the battery or the power cord when the vacuum cleaner operates in the corded mode and the cordless mode, respectively. The electrical connection interface may be a standardized electrical connection interface to simplify assembly and increase the compatibility of the vacuum cleaner with batteries and power cords. Also, the electrical connection interface provides a secure connection to the battery and the power cord. In addition, in the cordless mode, the battery may be connected to the vacuum cleaner such that the weight of the battery is evenly distributed throughout portions of the vacuum cleaner. In the corded mode, the power cord may be secured to the vacuum cleaner such that tension in the power cord is reduced and the power cord is prevented from disconnecting from the vacuum cleaner. In addition, embodiments of the vacuum cleaning system are easier to assemble and operate than previous vacuum cleaning systems.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A vacuum cleaning system comprising:

an upright vacuum cleaner operable in a cordless mode and a corded mode, the upright vacuum cleaner comprising:

a cleaning head for removing debris from a floor;

a debris tube pivotally connected to and extending from the cleaning head and terminating at a handle assembly for receiving the debris; and an electrical connection interface located on the debris tube;

a battery adapted for connection to the electrical connection interface, wherein the upright vacuum cleaner operates in the cordless mode when the battery is connected to the electrical connection interface; a support plate attached to and extending from the debris tube to support the battery, wherein the support plate is located between the cleaning head and the handle assembly; and a power cord adapted for connection to the electrical connection interface, wherein the vacuum cleaner operates in the corded mode when the power cord is connected to the electrical connection interface.

2. The vacuum cleaning system of claim 1, wherein the electrical connection interface conforms to standards of the International Electrotechnical Commission (IEC).

3. The vacuum cleaning system of claim 2, wherein each of the battery and the power cord includes an electrical connection interface that conforms to standards of the IEC.

4. The vacuum cleaning system of claim 3, wherein the electrical connection interface of the vacuum cleaner is an IEC Appliance type C18 Inlet.

5. The vacuum cleaning system of claim 4, wherein the electrical connection interfaces of the battery includes an IEC type C13 connector and the power cord includes a C17 connector.

6. The vacuum cleaning system of claim 1, wherein the electrical connection interface is positioned on an exterior of the vacuum cleaner.

7. The vacuum cleaning system of claim 1, wherein the handle assembly includes a handle and a cord holder connected to the handle, wherein the cord holder receives the power cord to relieve tension on the power cord when the power cord is connected to the electrical connection interface.

8. The vacuum cleaning system of claim 7, wherein the cord holder includes an annular body defining an opening and a hook extending across the opening.

9. The vacuum cleaning system of claim 1, wherein the electrical connection interface is attached to the support plate.

10. An upright vacuum cleaner operable in a cordless mode and a corded mode, the upright vacuum cleaner comprising:

a cleaning head for removing debris from a floor;

a debris tube pivotally connected to and extending from the cleaning head for receiving the debris;

a handle assembly attached to the debris tube, the debris tube extending from the cleaning head and terminating at the handle assembly;

a support plate attached to and extending from the debris tube to support a battery, wherein the support plate is located between the cleaning head and the handle assembly; and an electrical connection interface attached to one of the handle assembly, the debris tube, and the support plate, the electrical connection interface adapted for connection to the battery and a power cord, wherein the upright vacuum cleaner operates in the cordless mode when the battery is connected to the electrical connection interface and operates in the corded mode when the power cord is connected to the electrical connection interface.

11. The upright vacuum cleaner of claim 10, wherein the electrical connection interface conforms to standards of the International Electrotechnical Commission (IEC).

12. The upright vacuum cleaner of claim 11, wherein the electrical connection interface of the vacuum cleaner is one of an IEC Appliance type Inlet and an IEC type connector.

13. The upright vacuum cleaner of claim 12, wherein the electrical connection interface of the vacuum cleaner is an IEC Appliance type C18 inlet.

14. The upright vacuum cleaner of claim 13, wherein the electrical connection interface is configured to receive an IEC type C13 connector and a C17 connector.

15. The upright vacuum cleaner of claim 10, wherein the electrical connection interface is positioned on an exterior of the vacuum cleaner.

16. The upright vacuum cleaner of claim 10, wherein the handle assembly includes a handle and a cord holder connected to the handle, and wherein the cord holder receives the power cord to relieve tension on the power cord when the power cord is connected to the electrical connection interface.

17. The upright vacuum cleaner of claim 16, wherein the cord holder includes an annular body defining an opening and a hook extending across the opening.

18. The upright vacuum cleaner of claim 10 further comprising a power switch on the handle assembly, the power switch being positionable between an ON position and an OFF, wherein power is supplied to the upright vacuum cleaner through the power cord when the power cord is connected to the electrical connection interface and the power switch is in the ON position, and DC power is supplied to the upright vacuum cleaner from the battery when the battery is connected to the electrical connection interface and the power switch is in the ON position.

* * * * *